US006260720B1

(12) United States Patent
Gunnarsson et al.

(10) Patent No.: US 6,260,720 B1
(45) Date of Patent: Jul. 17, 2001

(54) TWO ARMS SYSTEM

(76) Inventors: Wiking Gunnarsson, Signebyn 11, S-660 10, Dalslånged; Karl Gustav Lindqvist, Törsängen 40, S 668 93 Ed, both of (SE)

( * ) Notice: Subject to any disclaimer, the term of this patent is extended or adjusted under 35 U.S.C. 154(b) by 0 days.

(21) Appl. No.: 09/367,866

(22) PCT Filed: Mar. 2, 1998

(86) PCT No.: PCT/SE98/00367

§ 371 Date: Nov. 18, 1999

§ 102(e) Date: Nov. 18, 1999

(87) PCT Pub. No.: WO98/39243

PCT Pub. Date: Sep. 11, 1998

(30) Foreign Application Priority Data

Mar. 3, 1997 (SE) ..... 9700750

(51) Int. Cl.[7] ..... B66C 23/42

(52) U.S. Cl. ..... 212/300

(58) Field of Search ..... 212/297, 300, 212/238, 260, 261, 262

(56) References Cited

U.S. PATENT DOCUMENTS

| | | | | |
|---|---|---|---|---|
| 3,828,939 | * | 8/1974 | Tranchero | 212/300 |
| 4,770,271 | * | 9/1988 | Tranchero | 212/261 |
| 5,197,615 | * | 3/1993 | Gunnarson | 212/300 |
| 5,507,107 | * | 4/1996 | Pinomake | 212/300 |

* cited by examiner

*Primary Examiner*—Thomas J. Brahan
(74) *Attorney, Agent, or Firm*—Dennison, Scheiner, Schultz & Wakeman

(57) ABSTRACT

Unit cranes consist of three hinged arms (13–15), the middle arm (14) being in the form of a polygon comprising a number of units jointed together, the flexibility of the units being arranged by influencing the units internally. The object of the invention is to achieve improved traction curves and speed curves, and this is effected by influencing the movement of the units from the outside by means of a hydraulic mechanism (38).

25 Claims, 16 Drawing Sheets

FIG. 4
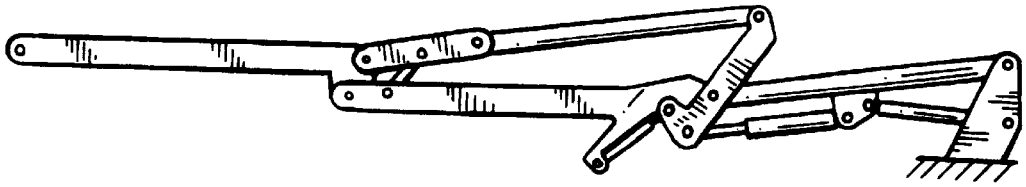
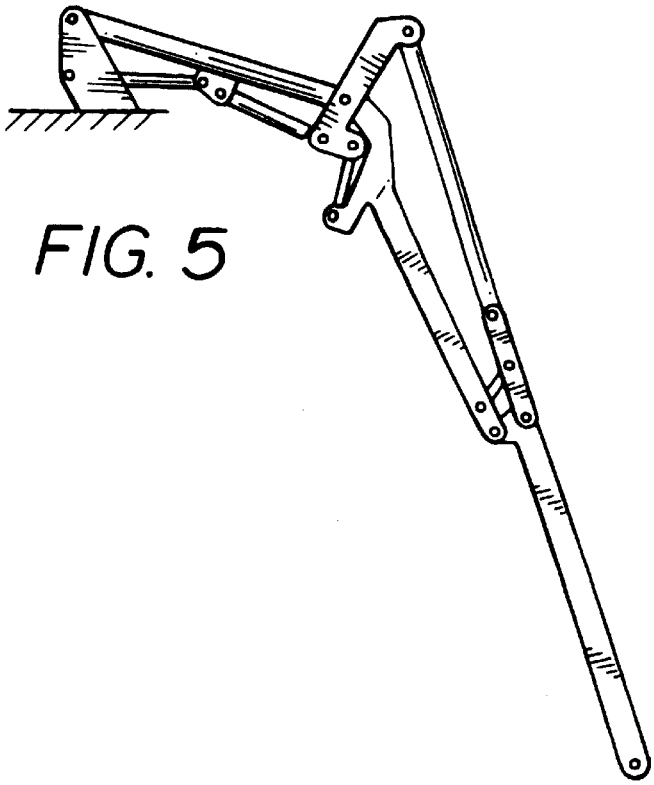
FIG. 5
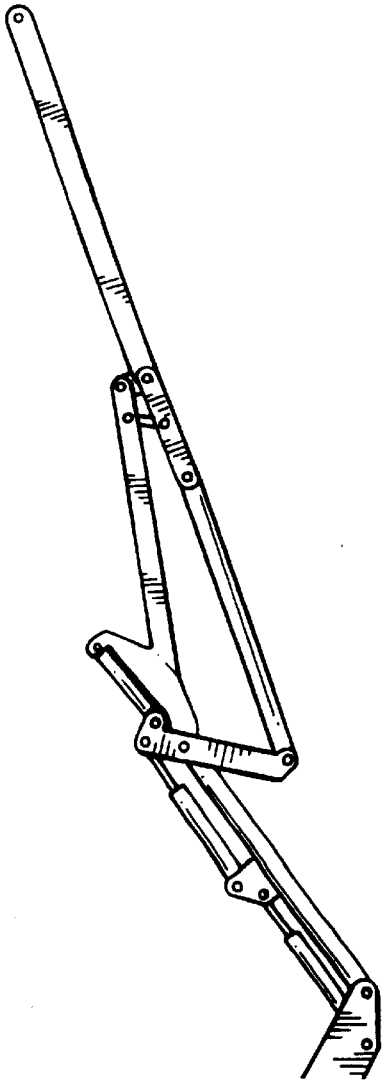
FIG. 6

FIG. 8
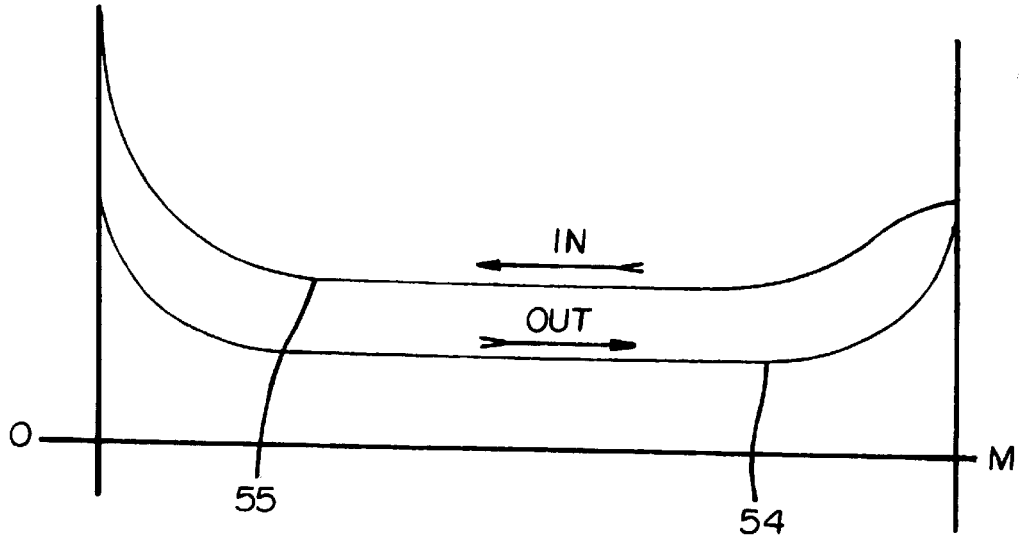
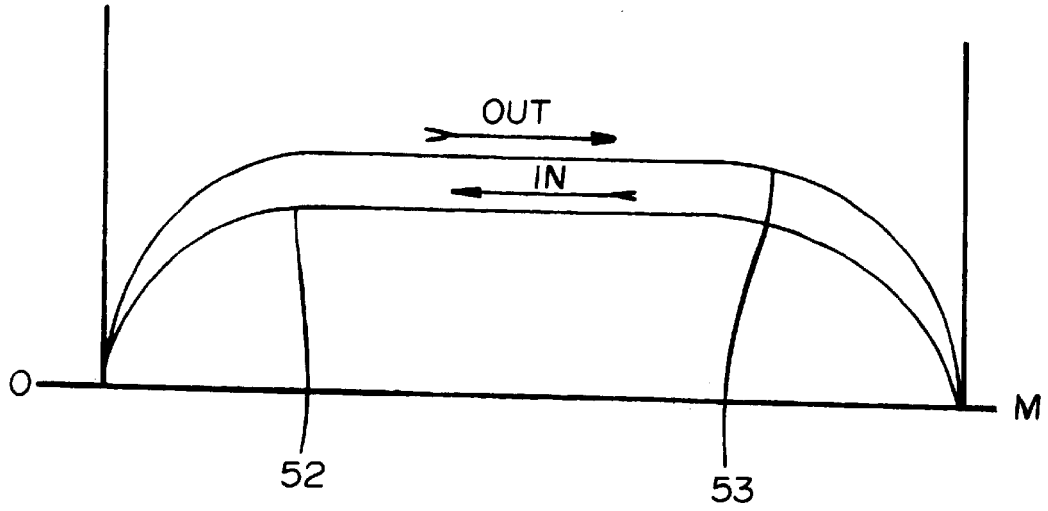
FIG. 9

TWO ARMS SYSTEM

FIELD OF THE INVENTION

The present invention is directed to a two arms system, and more specifically, toward an improved two arms system for a unit crane.

BACKGROUND OF THE INVENTION

There is a considerable call for a two-armed system for unit cranes, for instance. Such a crane consists of a rigid arm and thereafter an arm composed of a number of part-arms joined together which can be influenced hydraulically in such a manner that the part-arms form a polygon. This arm is in turn attached to a stand or to said stand via a supporting arm. The two arms in the system, together with a supporting arm if used, can thus be arranged to be situated one above the other and also so that all the arms are extended. Various units can be attached at the tip of the rigid arm, for use in clearing trees and bushes. Units functioning as excavators or loading means can also be attached, or even a concrete pump or concrete hose. In existing systems with two arms, the arm able to form a polygon is influenced by a hydraulic unit arranged between the arm parts so that, when the polygon is extended, the unit is located substantially in the middle of the polygon. Certain problems have been found to occur when operating such two-armed systems, as regards speed control of the top of the rigid arm, and problems also occur as regards the force exerted at said tip. Such a unit crane is suitable fitted on a caterpillar vehicle and this involves the problem of how to fold up the crane when it is not in operation. The arms will usually have a substantially vertical position, or they will be situated on the roof of the vehicle. There is also the problem of the actual joints of the unit arms being as stable as possible.

SUMMARY OF THE INVENTION

The object of the present invention is to solve the above-mentioned drawbacks and this is achieved by it being possible for both the arms in the system to be caused to lie one above the other, and possible also above a supporting arm so that, when the arm system is not in use the free end of the arm with several parts is attached either to a stand or to one end of a supporting arm, the other end of which is journalled in the stand. When folded up, therefore, the actual working tip or crane tip of the journalled package will be situated at the opposite part of the stand. To achieve suitable lifting power and suitable speed the crane tip is moved from a packaged position to the position is assumes when the tip is furthest away from the stand. The hydraulic mechanism influencing the arm with the many parts is arranged so that it influences two points situated outside two adjacent arm parts.

According to a preferred embodiment of the invention it is suitable to use a supporting arm which is in connection with a stand. In this case it is advisable to use two pairs of hydraulic cylinders. One pair of hydraulic cylinders is connected to the stand and to a point between the ends of the supporting arm. The supporting arm can be caused to move about its journalling point by means of one of the hydraulic cylinders. At the point between the two ends of the supporting arm it is suitable to arrange a bearing for a pair of hydraulic cylinders, one end of which is connected to said journalling point and the other end of which communicates with one end of the arm that can form a polygon. The first pair of hydraulic cylinders is used so that one hydraulic cylinder of the pair controls the movement of the supporting arm while the other hydraulic cylinder, together with the second pair of hydraulic cylinders, forms a closed hydraulic system, and since the second hydraulic cylinder in the first pair is parallel with the hydraulic cylinder infulencing the movement of the supporting arm, the second hydraulic cylinder in the first pair will automatically control the movement of the two hydraulic cylinders influencing the arm able to form a polygon. This arrangement of hydraulic cylinders provides smoother movements of the whole crane, as well as enabling savings in energy.

The stand to which the supporting arm is attached can be caused to moved in a number of different ways known per se. However, it has proved particularly advantageous if the stand is provided at its journalling end with one or more toothed wheel rims situated one above the other, each cooperating with a chain designed for cooperation with a toothed wheel, each chain being joined at its ends and the chains being influenced by a hydraulic system so that the chains are caused to move and influence the pin of the stand in order to effect movement of the stand.

The arrangement described above with toothed wheel and chain allows the crane to be moved as large an angle as possible in both direction. However, if the demand for a large turning angle is not so great, it is much simpler and less expensive to use two links joined together for each piston rod.

Such a unit crane with its stand is suitable arranged on a platform provided with cab in such a way that the arm system in the form of a package does not come into contact with the cab in any way. The vehicle carrying the crane package may be part of a centrally controlled vehicle in which the engine is jointed to the supporting part for the crane package. By arranging the hydraulic unit outside the arm with the many part arms, the advantage is gained that the crane can be brought to be more or less horizontal with the various arms arranged one after the other and that it can be caused to assume a substantially downwardly-directed vertical position and upwardly-directed vertical position. The many joints in the arm system are subjected to considerable strain and it is therefore suitable for two arms to be combined so that one arm has two parallel shafts between which a pin located on the other arm is passed. The pin and the two arms together form a through-hole for a shaft journal. Each end of the shaft journal is provided with a tensioning ring having a conical surface and a tensioning cone, also having a conical surface, cooperating therewith. These two units with conical surfaces are brought into rigid contact with each other since the end cone is provided with a tightening bolt that can be screw into each end of the shaft journal. Reliable functioning of the shaft journal located at a point about which the two arms can be oscillated is thus achieved.

Additional characteristics of the present invention are revealed in the appended claims.

BRIEF DESCRIPTION OF THE DRAWINGS

The present invention will now be described in more detail with reference to the accompanying drawings in which

FIGS. 4–6 show various positions of a unit crane,

FIG. 8 shows how the force in a crane tip varies between two possible positions of the crane tip, FIG. 9 shows how the speed of the crane tip varies between its two outermost positions.

DETAILED DESCRIPTION OF THE INVENTION

Figure 2:
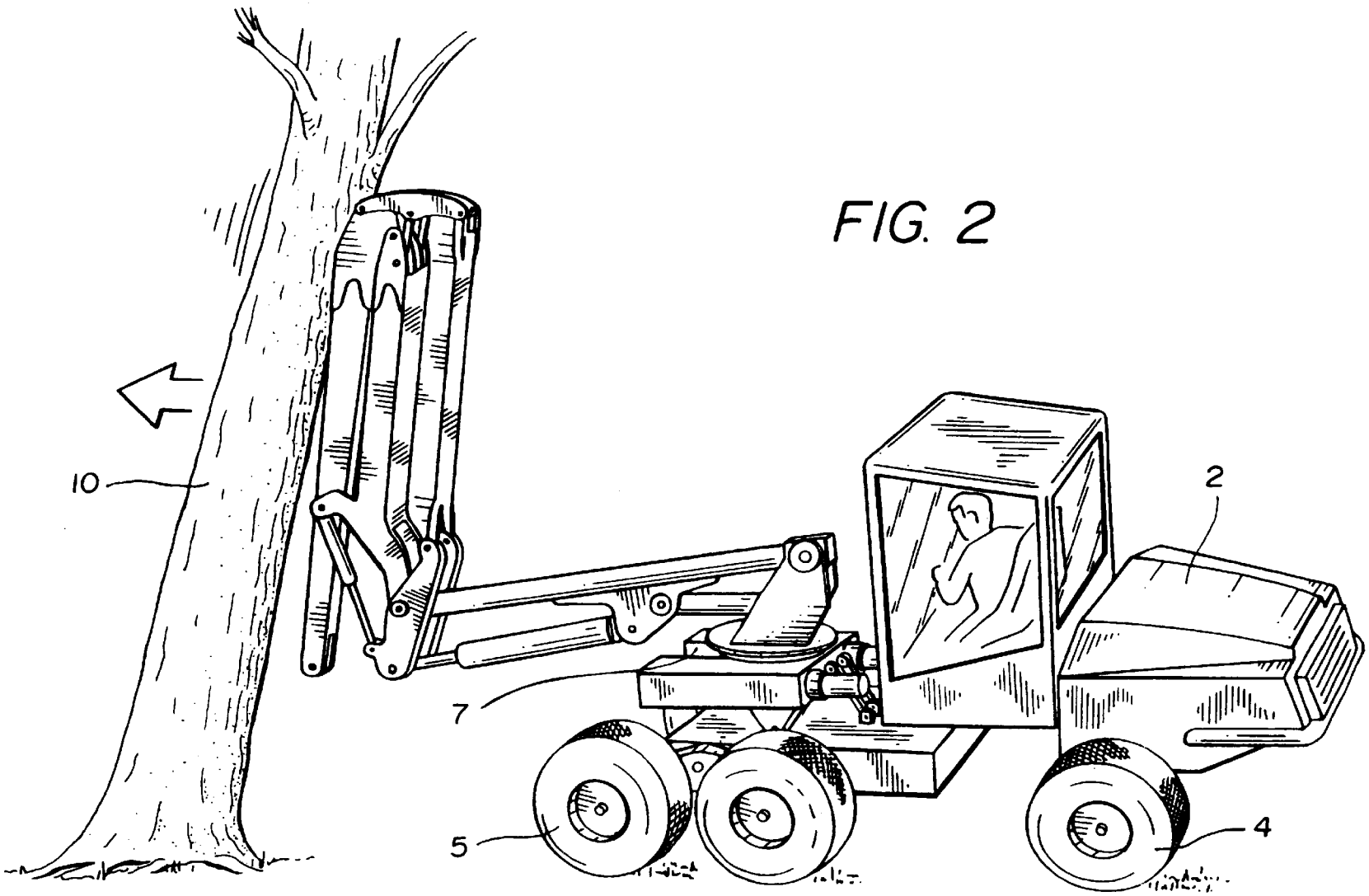
FIG. 2 shows the vehicle at a work place where the unit crane is manipulating a tree.
Figure 11:
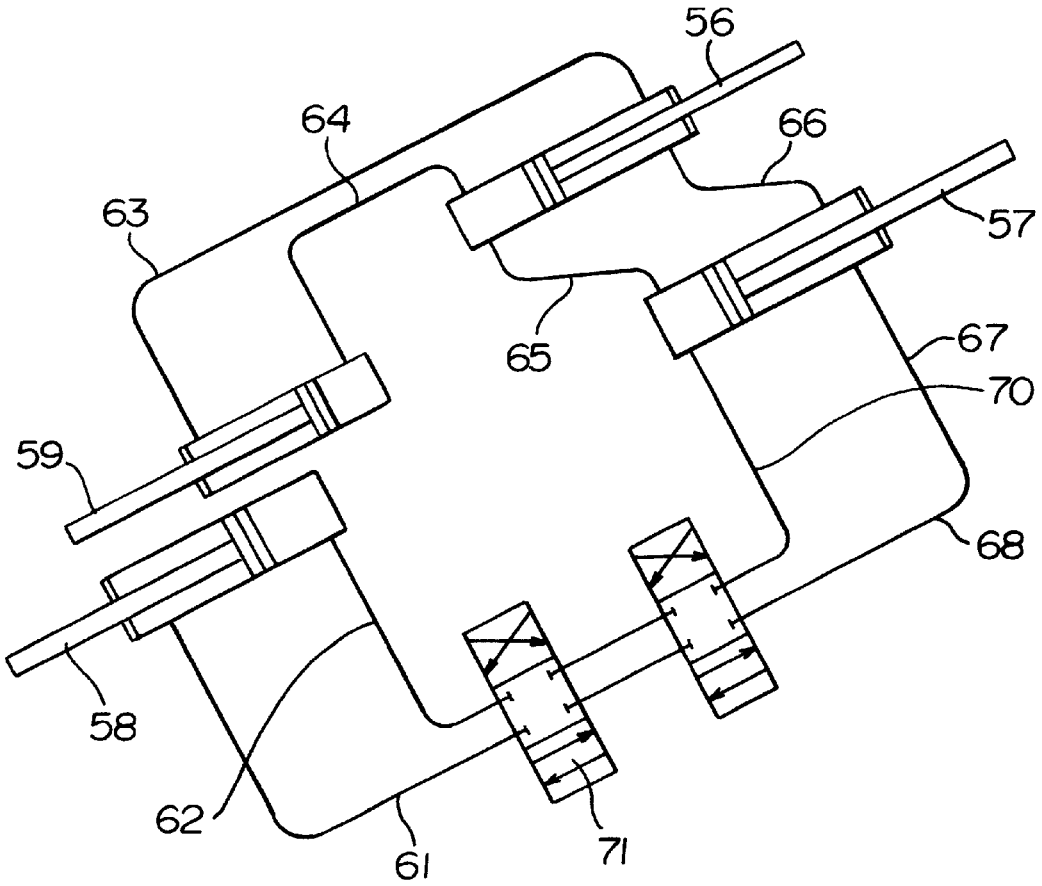
FIG. 11 shows a flow chart for the hydraulics for the pistons according to FIG. 10.

In FIG. 11 designates a centrally controlled vehicle with a unit crane. The vehicle has an engine part arranged pivotably in relation to the support unit 3 for a crane unit. The engine part has a pair of front wheels and the support part 3 has bogie wheels 5. A cab 6 is arranged on the support part. This cab may be pivotable depending on which direction the vehicle is to be driven in. Naturally the cab may also be stationary and control means may be arranged in the cab so that the operator need only turn his seat 180°. A stand is arranged on the supporting unit, said stand being pivotably arranged by means of bearings 11, the movement of the stand being achieved with the aid of hydraulic cylinders 12. The complete crane package consisting of three arms has been designated 8. Considering now the centrally controlled vehicle 1 in FIG. 2, this is shown in operation and it can be clearly seen that the arm package has a two-armed system 9 and also a supporting arm 13. The two-armed system is shown manipulating an object 10, which in the present case is a tree, and the operation shown comprises the vehicle with the crane package attempting to exert pressure on the tree.

Figure 3:
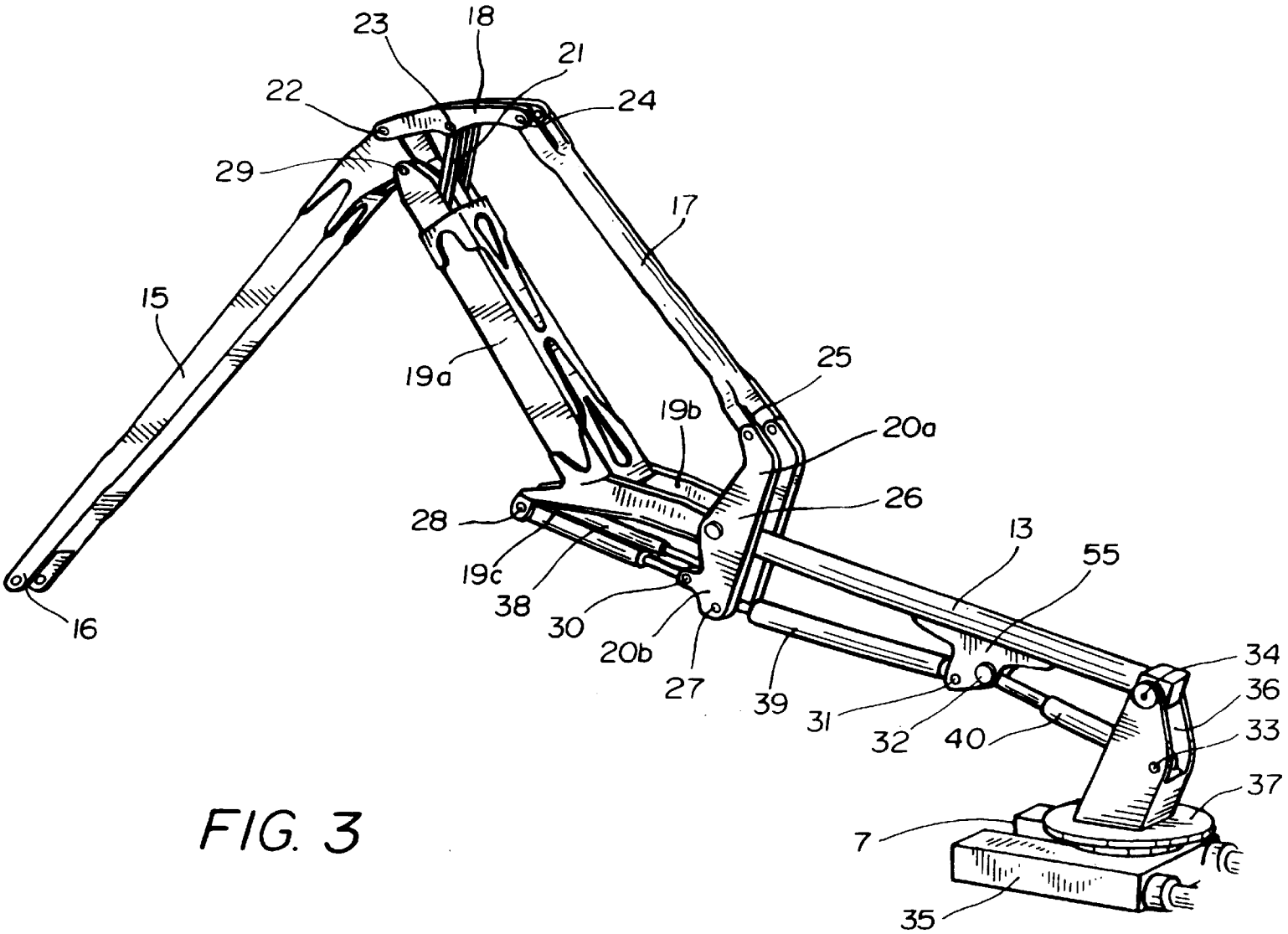
FIG. 3 shows a unit crane and stand in partially extended position.

FIG. 3 shows the crane package with stand in partially extended position. It can be seen that the inner arm 14 in the two-armed system is journalled at one end to a rigid arm 15 with a crane tip 16. The inner arm 14 is journalled at its inner end on a supporting arm 13 which is in turn journalled on the stand 7. The inner arm 14 consists of a first arm 17, a second arm 18, a third arm 19 and a fourth arm 20. All journalling points 22–34 joining the various parts of the arms together may be of the same type. One end of an arm part consists of two shaft parts and the connecting arm part consists of a studlike part which is placed between the two parts, the two parts and the stud part having holes that form a common hole for a shaft journal and this shaft journal is anchored in a special manner to be described in the following. The journalling points 22–34 thus constitute joint points for the units in the unit crane. The rear arm 14 in the crane has an arm 19*a* that is substantially solid and is provided at its end with two parallel arms with a part 19*b* forming a part of the actual rear arm, whereas the part 19*c* is completely protruding. The fourth arm also consists of two parallel parts spaced from each other, and has a part 20*a* included in the rear arm 14 and a part 20*b* that protrudes outside the rear arm 14. Two intermediate arms are journalled at their free ends, between the middle of the second arm 18 and the upper end of the arm 19*a*. The lower end of the stand 7 comprises a plate, pivotable in relation to a substantially parallelepipedic part 35 which is turnable about a horizontal axis by means of hydraulic cylinders 12 shown in FIG. 1. Above the pivotable plate 37 the stand 7 is provided with two flanges 36. Between the two journalling points 28 and 30 are two hydraulic cylinders that influence the relative movement between the two arms in the two-armed system. At the middle of the supporting arm 13 is a flange arrangement with two journalling points 31 and 32. A hydraulic arrangement 39 is situated between the journalling points 27 and 32, and a hydraulic arrangement 40 is similarly arranged between the journalling points 31 and 33. The relative position between the two arms 14 and 15 in the two-armed system is controlled by the hydraulic arrangement 38. The two-armed system is in turn also influenced by the hydraulic cylinder arrangement 39 and the hydraulic cylinder arrangement 40 situated between the journalling points 31 and 33 controls the position of the supporting arm 13 which also has another influence, as already mentioned, namely that the position of the parallelepipedic unit 35 is influenced by the hydraulic arrangement 12.

FIGS. 4, 5 and 6 demonstrate how the three arms in the crane package can be brought to three extreme outermost positions. FIG. 4 shows a purely horizontal position, FIG. 5 directed vertical downwards and FIG. 6 directed vertically upwards.

Figure 7:
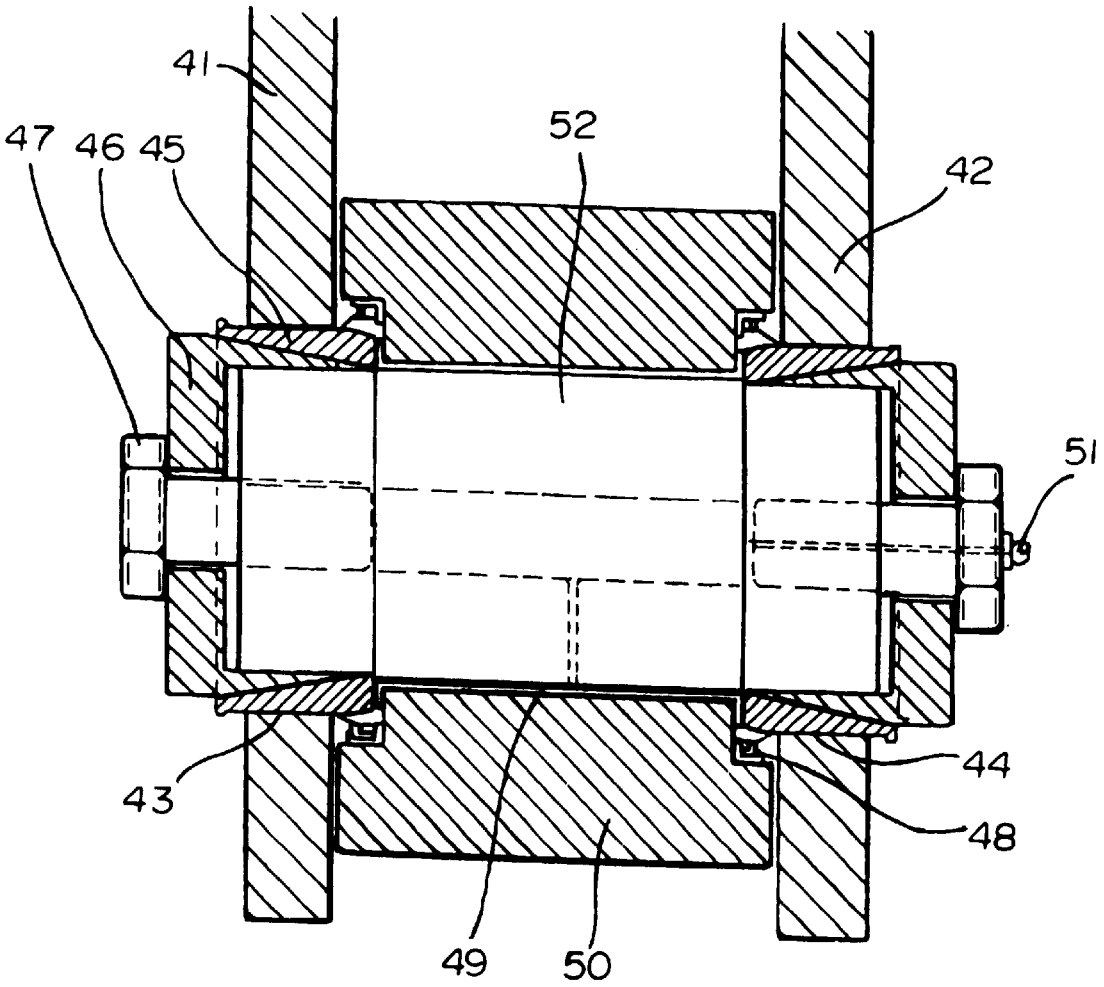
FIG. 7 shows an arrangement for retaining shaft journals at a joint.

FIG. 7 shows how two arm ends can be joined together. In this case, one arm end must comprise two shafts or lugs 41 and 42 situated opposite each other and spaced apart. Each of the two shafts 41 and 42 is provided with a hole 43 and 44. A solid stud 50 arranged at the end of the arm to be connected is inserted between the two shafts. This stud or journal is provided with a through-opening 49. When the two arm ends are brought into engagement with each other, the openings 43, 44 and 49 will be situated opposite each other and a shaft journal 52 is inserted through them. A tensioning ring with an inner conical surface is applied at each end of the shaft journal and is placed in the holes 34 and 44. A tensioning cone 46 with a bottom and a cylindrical wall, conical on the outside, is applied at each end of the shaft journal 52. The conical surface of the tensioning cone 46 is brought into contact with the conical surface of the tensioning ring 45. In the bottom of the tensioning cone is an opening for a tightening bolt, threaded for engagement with an opening, also with threading, in the shaft journal. The two conical surfaces can thus be brought into firm contact with each other so that the shaft journal is immovable in the two outer holes 43 and 44. The shaft journal 52 may be provided with a grease cup 51 so that the bearing can be provided internally with lubricant. The bearing arrangement described can be used in all bearing arrangements in the unit crane or just in certain selected bearings, but it should be obvious that the bearing according to FIG. 7 is generally usable and may have applications entirely different from vehicles with unit cranes.

Figure 1:
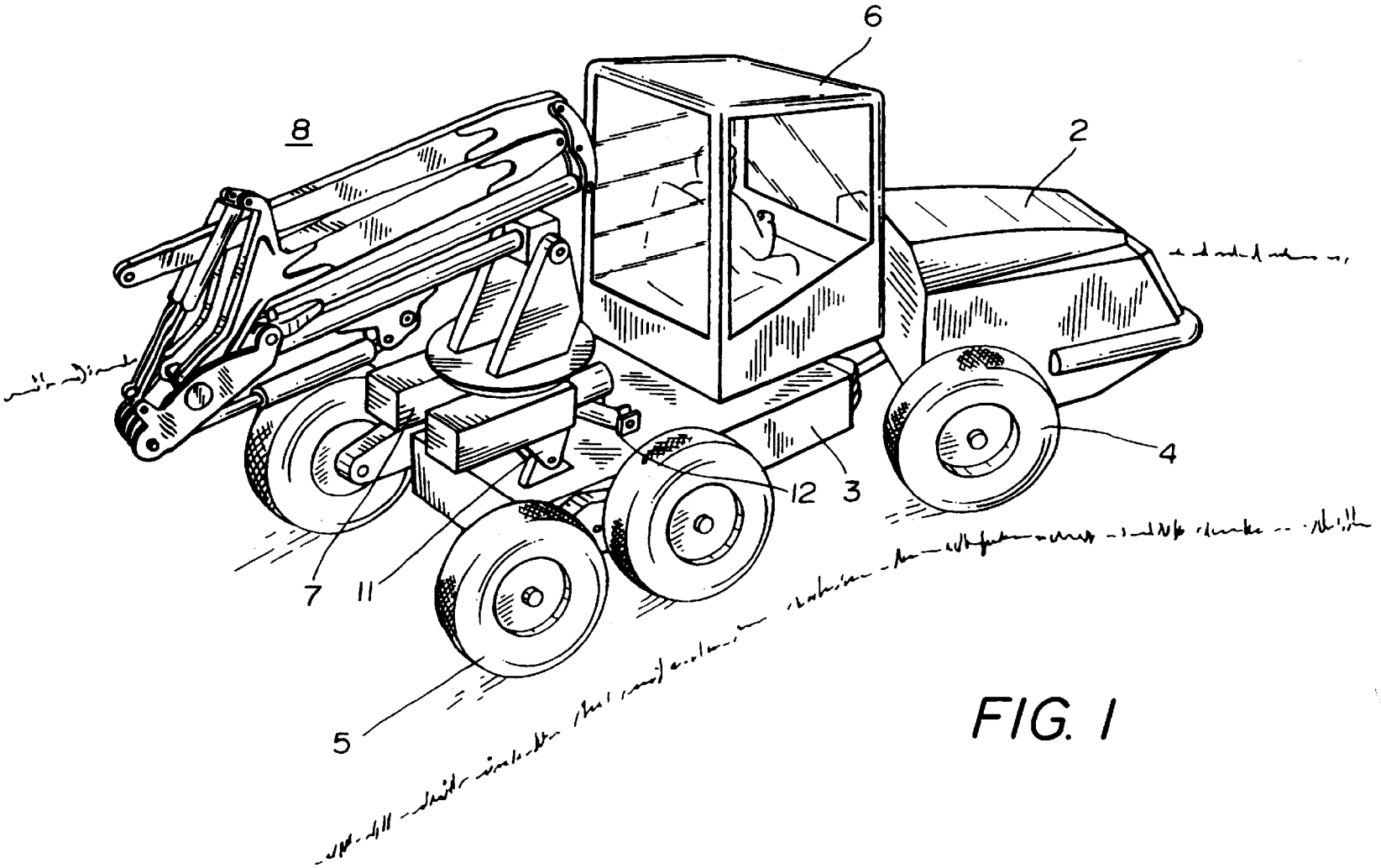
FIG. 1 shows a centrally controlled vehicle with a crane package in rest position, the vehicle being on its way to a work place.

The crane tip in the unit crane has two outermost positions, one as shown in FIG. 1 and the other as shown in FIG. 4. Between these two extreme positions the curves in FIG. 8 have been taken up for forces operating on the crane tip, the curve 54 showing how the force varies from the inner position in FIG. 1 to the outer position in FIG. 4. Curve 55 also shows how the force varies in an inward movement. Curve 53 in FIG. 9, finally, shows the speed of the crane tip from the situation according to FIG. 1 to that according to FIG. 4 and curve 52 shows the equivalent speed during an inward movement. It is thus clear that the present invention has managed to produce a vehicle with a unit crane where, when not in use, the crane forms a convenient package, substantially horizontal, and is at a low level when the three arms are arranged one after the other, which is an advantage since the crane is then easy to service. It may then be suitable to bring the crane into the position shown in FIG. 4. Another advantage is that the crane will on no account come into contact with the driver's cab 6. No special vehicle is necessary as previously to transport the unit crane, and crane and vehicle provide an advantageous unit through the use of a centrally controlled vehicle.

It is clear that the speed and lifting capacity of the crane tip 16 vary depending on the hydraulic pressure used.

The embodiment shown in FIGS. 12–16 comprises a housing 71 in which a shaft 72 is pivotably journalled, the outward end 73 of which is designed for mounting of the tool or unit which the pivoting arrangement is designed to handle. In the example shown the shaft 72 is provided with two chain wheels 74 which are firmly secured to the shaft.

The housing 71 is also provided with a first cylinder 75 and a second cylinder 76, the axes of these cylinders being parallel. A first piston rod 77 connected to a piston is displaceably arranged in a first cylinder 75 and a second piston rod 78 connected to a piston is displaceably arranged in the second cylinder 76. The first piston rod 77 is provided at its free end with a first chain wheel 79 and the second piston rod 78 is provided with a second chain wheel 80. The chain wheels 79 and 80 are freely pivotable in the ends of respective piston rods 77, 78 about shafts parallel to the shaft 72.

Figure 12:
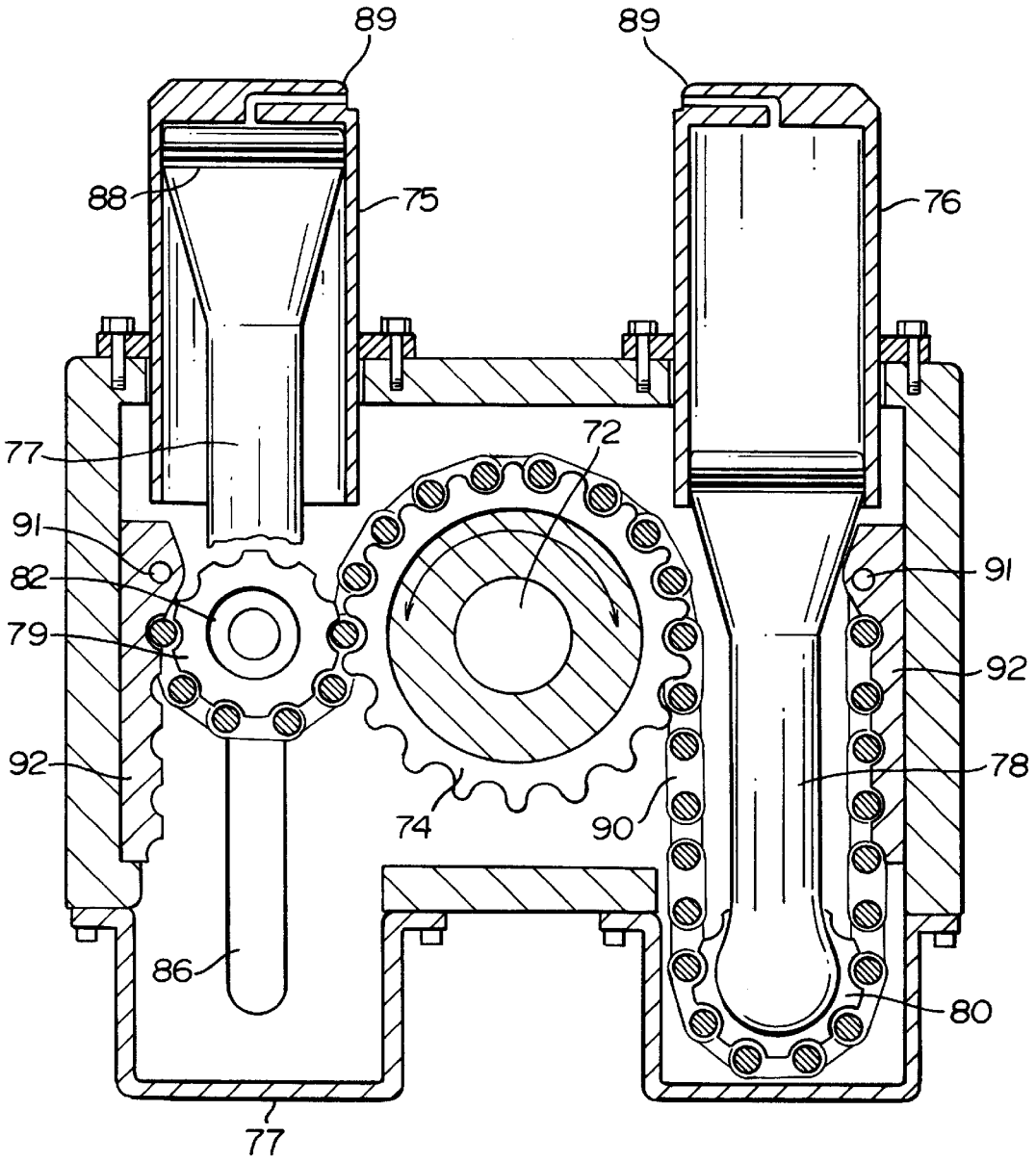
FIG. 12 shows schematically a section of the turning device for the stand according to FIG. 3.
Figure 13:
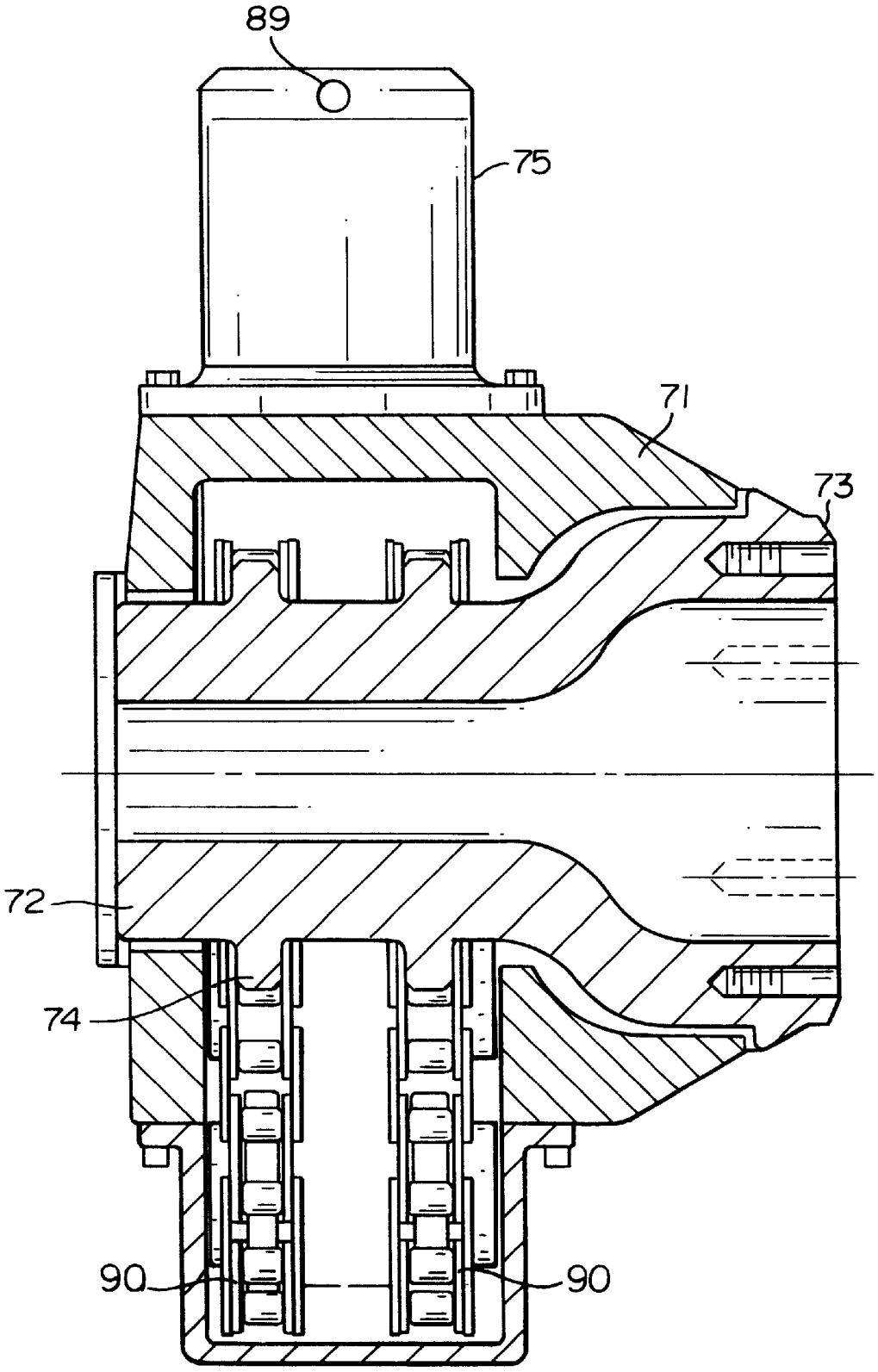
FIG. 13 shows a section along the line 22 in FIG. 1.
Figure 14:
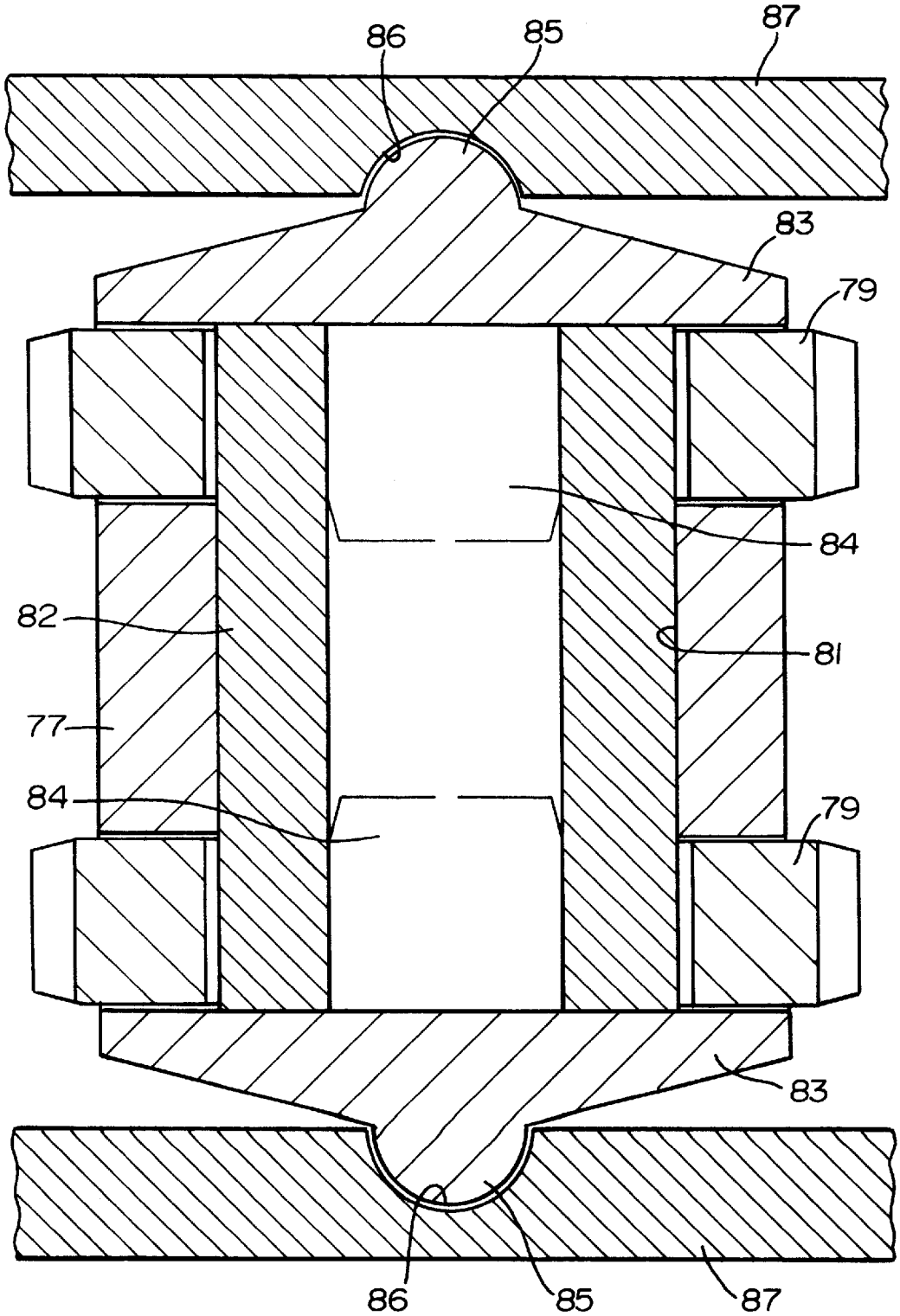
FIG. 14 shows a schematic section through a chain wheel.
Figure 15:
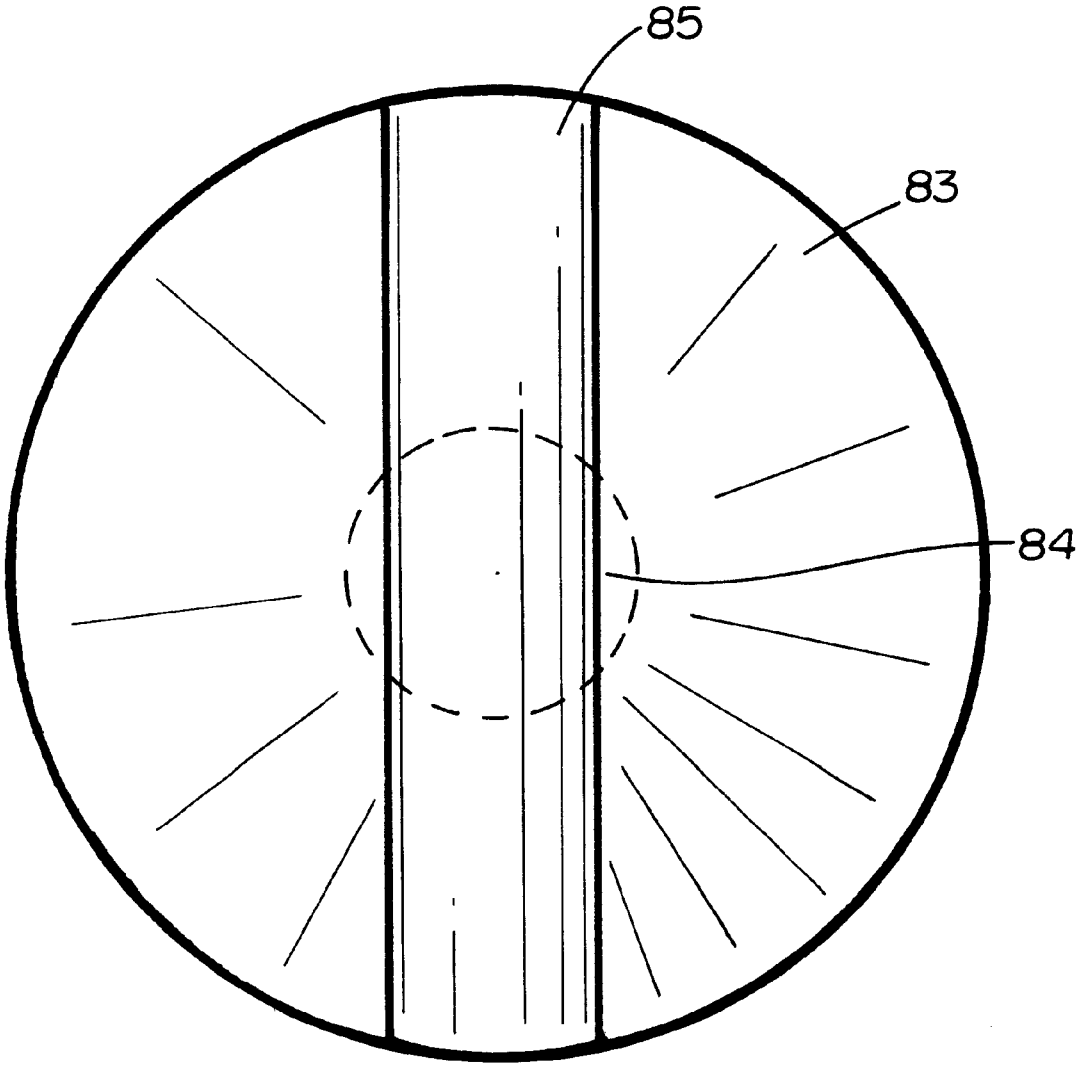
FIG. 15 shows a detail according to the arrangement in FIG. 12.

The arrangement is symmetrical and the piston rods 77, 78 with chain wheels 79, 80 are identical. Only the piston rod 77 with chain wheel 79 will therefore be described in connection with FIG. 14. The piston rod 77 is provided with a through-hole 81 in which a bearing sleeve 82 is journalled. In the example shown two chain wheels 79 are rotatably arranged on the bearing sleeve 82, and the piston rod forms a spacer between the chain wheels 79. On each side of the bearing sleeve 82 a lock and guide washer 83 is retained by its shaft 84 being inserted into the cavity in the bearing sleeve 82. The side of the washer 83 facing the bearing sleeve and chain wheel is flat and holds the chain wheel in place axially, while the end of the washer 83 facing away from the sleeve 82 has a guiding protrusion 85, semi-circular when seen in section, which has a certain axial extension as can be seen in FIG. 15. In the example shown the guiding protrusion extends across the diameter of the washer 83 and runs in groove 86, also semi-circular when seen in section, in the opposing walls 87 of the housing 71. The washers 83, bearing sleeve 82, chain wheel 79 and end of the piston rod 77 are thus axially "locked" between the walls of the housing 71. At the same time the grooves 86 and the guiding protrusions 85 running therein guide the end of the piston rod 77 linearly in the housing. As can be seen in FIG. 12, the piston connected to each piston rod 77, 78 has a partially spherical surface which cooperates with the cylinder 75, 76 and, in the example shown, is provided with a sealing ring 88. The pistons can be displaced in the cylinders via hydraulic or pneumatic channels 89.

Two long, flexible members for transmitting movement, e.g. in the form of two roller chains 90, only one of which is visible in FIG. 12, are secured to the housing 71 by their ends 91. Each chain passes 180° around the first chain wheel 79, continues 180° around the chain wheel 74 and then 180° around the second chain wheel 80. Chain guides 92 are provided at the attachment of the chain ends 91 to the housing 71 to guide and support the end portions of the chain. The first piston rod 77 with its piston and the second piston rod 78 with its piston are supplied with pressure fluid so that they move synchronously to and from but in opposite directions i.e. when the first piston rod 77 with its piston is in its uppermost position, as shown in FIG. 12, the second piston rod 78 with its piston is in its lowermost position.

It should be obvious that when the pistons and the piston rods 77 and 78 move synchronously in opposite directions, the chain running around the chain wheel 74 will move, thereby turning the shaft 72. How far the chain wheel 74, and thus the shaft 72, can be turned depends naturally on the length of the chain and the stroke length of the piston rods. However, for normal requirements a turning angle of 180° is sufficient for the shaft 72.

Since the pistons are constantly loaded with pressure fluid, the chains 90 remain taut and the arrangement is thus play-free. Since the chains encompass the chain wheel 74 along half of its circumference, as well as the first and second chain wheels 79 and 80, the surface pressure on the wheels will be reduced when the shaft 72 is loaded. The arrangement can thus have small dimensions while still being able to take up considerable loads.

Figure 16:
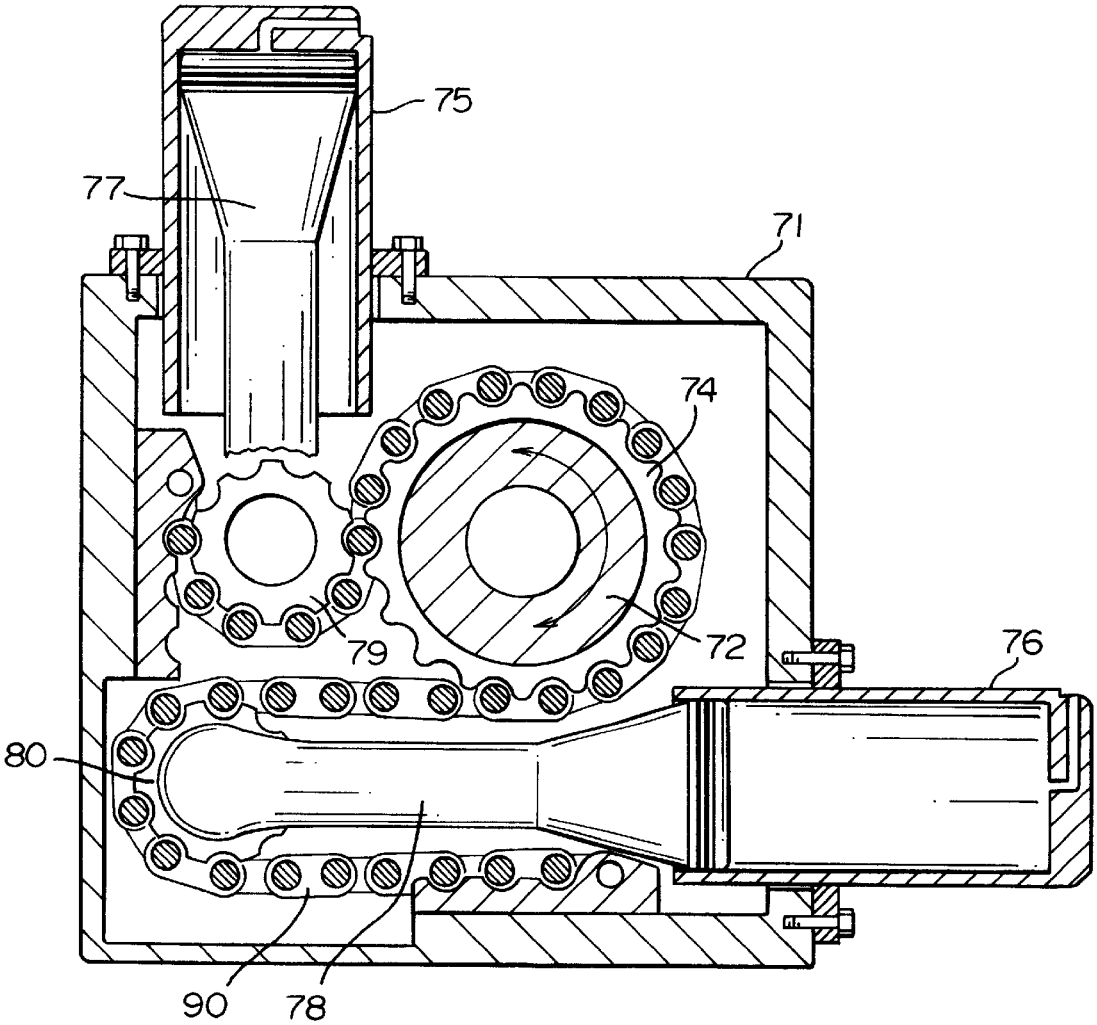
FIG. 16 shows a modification of the arrangement according to FIG. 12.

FIG. 16 shows a modified form of the invention, the cylinders 75 and 76 having been mounted at 90° to each other. The function is the same as described with reference to the embodiment shown in FIGS. 12–15. In the embodiment according to FIG. 16 the chain will encompass an angle of 270° of the chain wheel 74 by the shaft 72, thereby further distributing the load on the toothed wheel 74. For reasons of clarity the grooves 86 mentioned in connection with the description of FIGS. 12–16 have been omitted but may of course be included in this embodiment also. The grooves will then cross each other which does not, however, affect the function of the pistons and guide protrusions 15, the latter having elongate form as mentioned.

It is implicit that the wheels 79 and 80 do not necessarily have to be provided with teeth but may have some other peripheral surface depending on the type of chain. Cogged belts are also possible.

Figure 17:
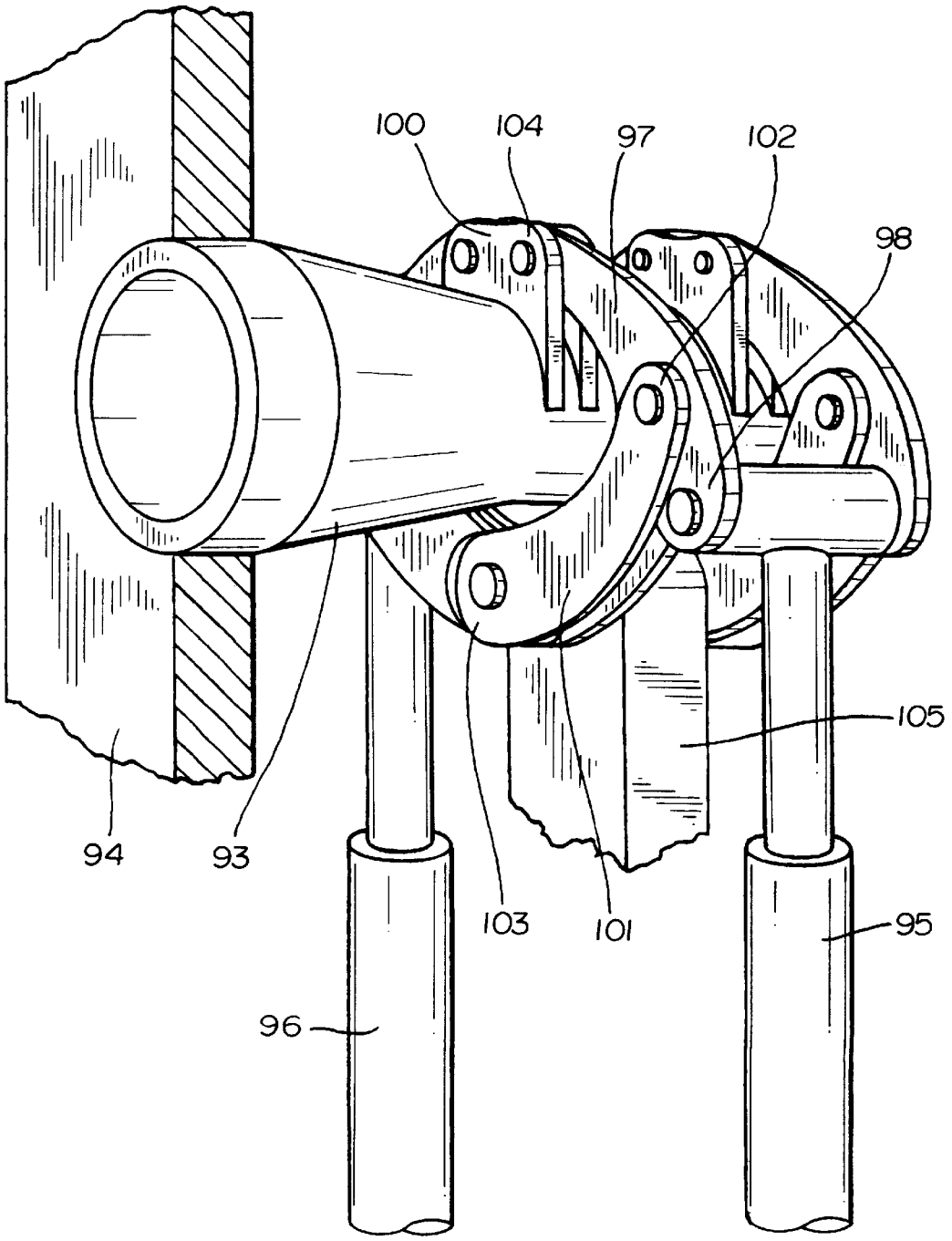
FIG. 17 shows a modification of the pivoting arrangement utilizing links.
Figure 18:
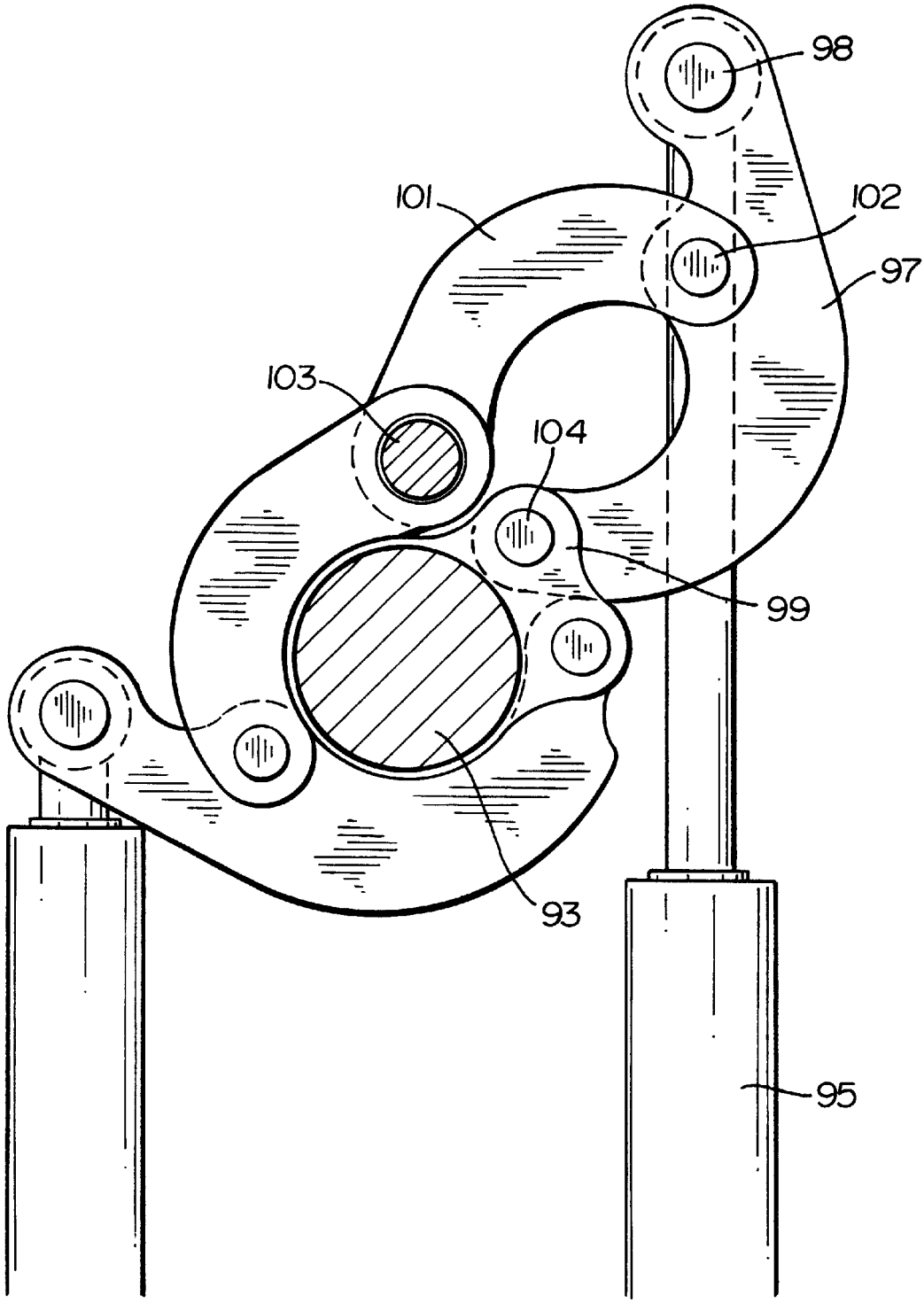
FIG. 18 shows an arrangement according to FIG. 17, seen from above.
Figure 19:
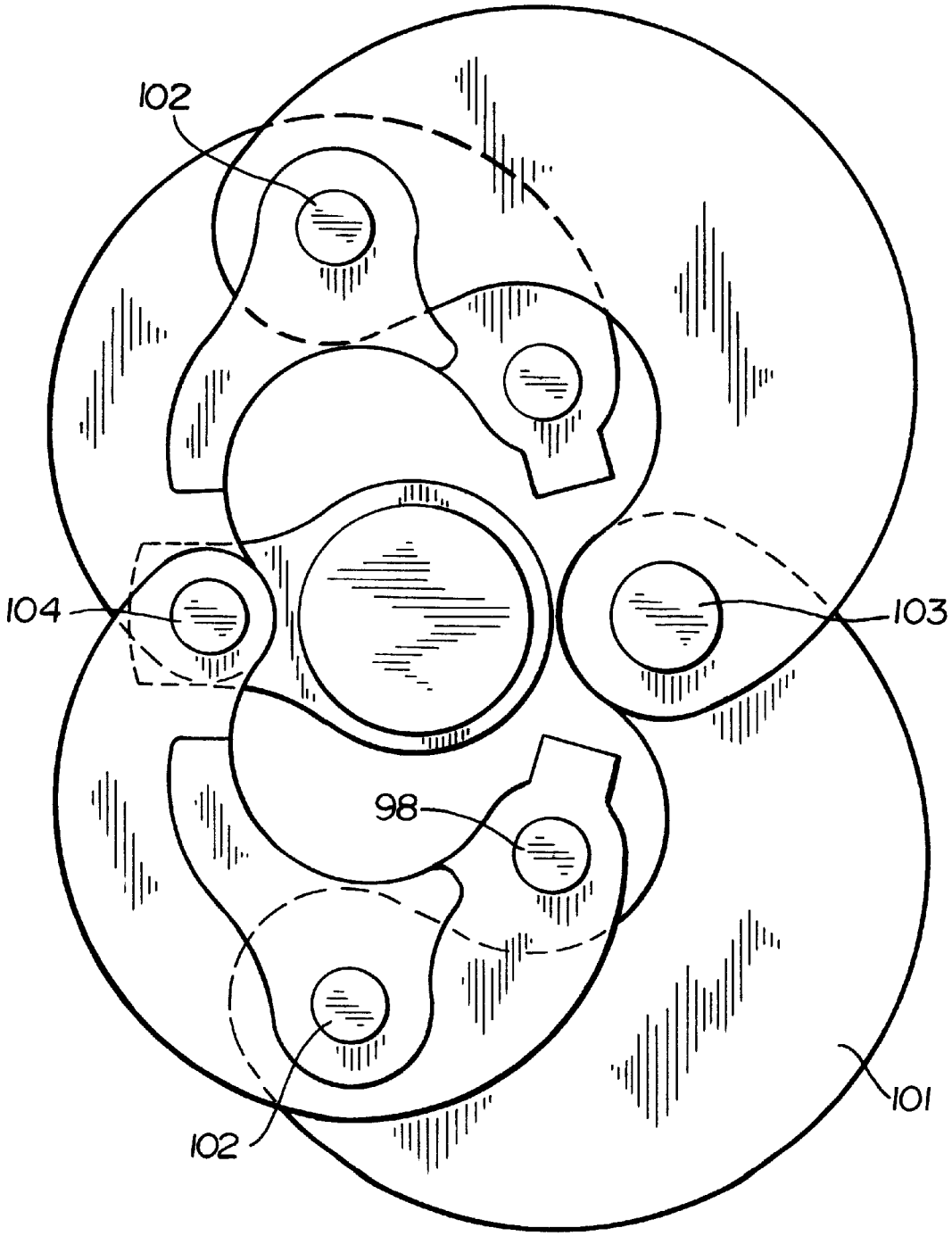
FIG. 19 shows only the links according to FIG. 17.

The arrangement described above for turning the stand with the aid of toothed wheel and chain is suitable if large turning angles are required for the unit crane. However, if such large turning angles are not necessary then it is both cheaper and simpler to use a link system instead of toothed wheel and chain. FIGS. 17 and 18 show in perspective and seen from above a turning arrangement which is simple and inexpensive to manufacture and which uses links instead of the chains and toothed wheels mentioned above. In most cases at least one or two piston rods are required to achieve turning in both directions, and in the present case the actual housing, designated 94, for the turning arrangement is shown. The pin or unit to effect turning of the stand is then designated 13 and is in the form of a substantially cylindrical unit journalled at its ends in some suitable manner. The link and piston arrangement of the cylindrical pin is arranged in a plane perpendicular to the central axis of the pin. A radially outwardly directed flange 100 is arranged in some way on the envelope surface of the cylindrical unit. On said flange are two journalling pints for two groups of links and piston rods. Obviously only one piston rod and two links are required to achieve turning movement in both directions but it is more advantageous to have two groups of links and pistons, the groups directed in different directions around the periphery of the unit. One group is connected at the flange 100 and a link 97 is provided here which is pivotable connected by one end 104 to the outwardly directed flange 100. The other end 98 is connected to the piston rod 95. A link 101, moveable via its end 102, is arranged between the two ends of the link 97. The other end 103 of the link 101 is journalled at a fixed point in the housing, arranged at a unit 104. It is thus only the end 103 that is moveable around a stationary point. The moveable parts are thus the link arms, piston rods and unit 93. Relatively large turning angles can be achieved in both directions thanks to the links being arc shaped. It has proved advisable to have two levels of identical links with a spacer between these levels arranged at one end 98 of the link 97 and corresponding ends for the other group with links and piston rods. It is advantageous to have two similar types of link systems arranged one above the outer as this enables a better point of application with the piston rods at the links in the different levels.

Figure 10:
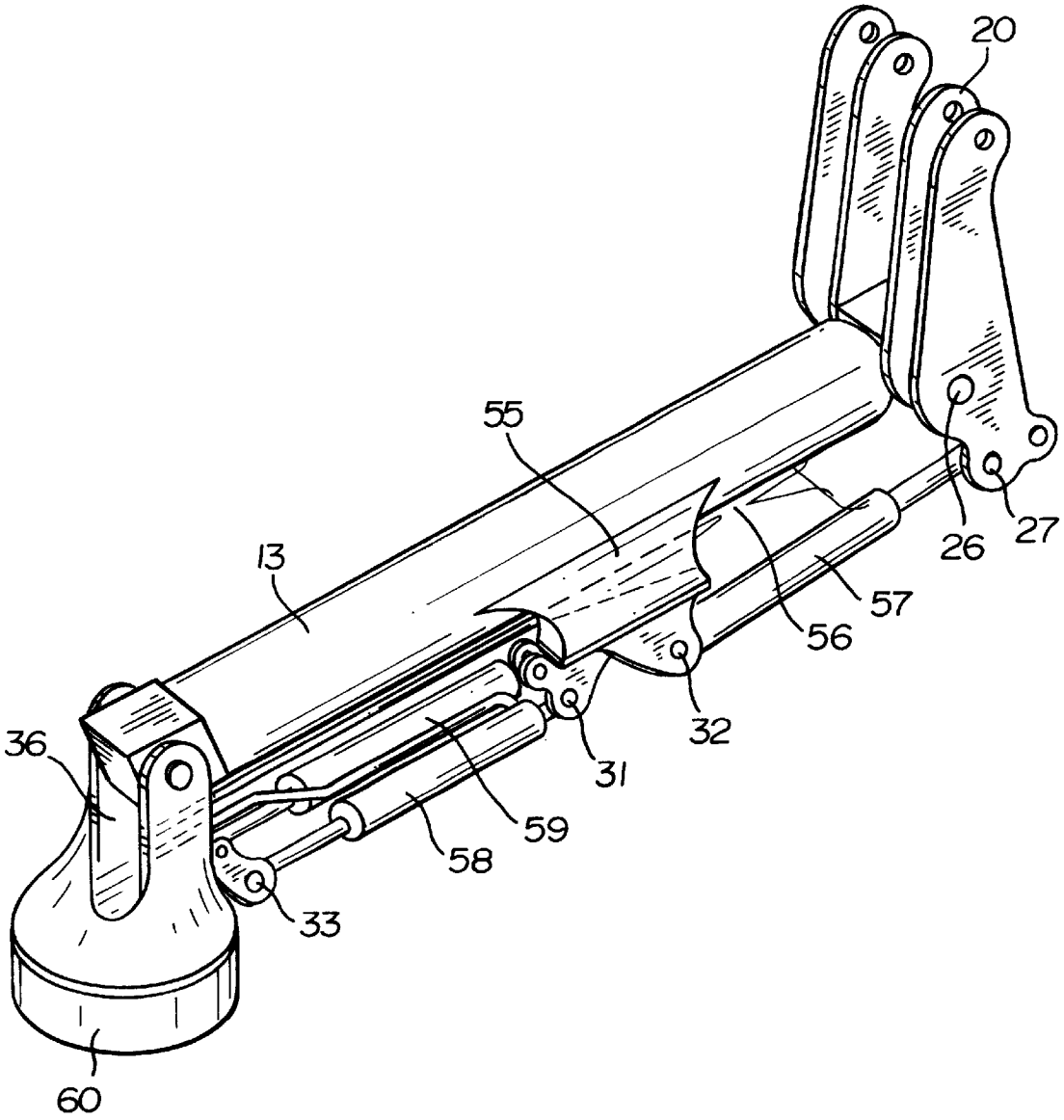
FIG. 10 shows a modification of the hydraulic system at the supporting arm according to FIG. 3.

FIG. 10 shows a variation of the supporting arm 13 in FIG. 3 where the hydraulic pistons 39 and 40 have been replaced with a first pair of hydraulic pistons 57 and 56 and a second pair of hydraulic pistons 58 and 59. The hydraulic pistons 56 and 57 replace the hydraulic piston 39 in FIG. 3 and these hydraulic pistons are journalled at their ends in the same way as the hydraulic piston 39. The hydraulic piston 40 according to FIG. 3 has been replaced in FIG. 10 with the hydraulic pistons 58 and 59. The hydraulic pistons in each pair are always located parallel to each other. The hydraulic pistons 56, 57 and 59 are hydraulically connected together in a closed system, whereas the hydraulic piston 58 is controlled by a control unit 71. The control unit 71 is connected hydraulically to the hydraulic cylinder 58 by the tubes 61 and 62, forming a closed hydraulic system, and controls the piston between its two ends, thereby raising and lowering the supporting arm 13 in relation to the post 60. Since the two pistons 58 and 59 are parallel to each other, the piston 59 will always follow the movement of the piston 58. The pistons 59, 56 and 57 are connected by tubes 63–70 to form a closed hydraulic system which means that when the piston 58 is caused to move by the control unit, the piston 59 will automatically move the pistons 56 and 57. Allowing the arm system to be influenced via the supporting arm 13 by two hydraulically closed system reduces the total kinetic energy required for the unit crane.

What is claimed is:

1. A system comprising a first rigid arm and a second arm connected to said first arm, said second arm comprising a plurality of arm segments hingedly interconnected to form a polygon, said plurality of arm segments comprising:

a first arm segment;

a second are segment having first and second ends;

a third arm segment comprising a linear portion and a base portion having first and second ends, said linear portion being connected to said base portion at a point between said first and second ends, said base portion second end extending outside the polygon formed by said plurality of arm segments;

a fourth arm segment having first and second ends, said third arm segment base portion first end being connected to said fourth arm segment at a point between said fourth arm segment first end and said fourth arm segment second end and said fourth arm segment second end extending outside the polygon formed by said plurality of arm segments;

at least one rod connected between the linear portion of said third arm segment and a point on said second arm segment between said second arm segment first end and said second arm segment second end; and, hydraulic actuator means connected between said third arm segment base portion second end and said fourth arm segment second end.

2. The system of claim 1 further including a third arm having a first end connected to said second arm and a second end connected to a pivotable and tiltable support.

3. The system of claim 2 wherein said third arm includes a protrusion between said third arm first end and said third arm second end, a second hydraulic actuator means connected between said protrusion and said fourth arm segment second end and a third hydraulic actuator means connected between said protrusion and said support wherein one of said second and said third hydraulic actuator means is controlled by the other of said second and third hydraulic actuator means.

4. The system of claim 2 wherein each of said second and said third hydraulic actuator means comprises a pair of hydraulic actuators, each of said pair a hydraulic actuators further comprising a piston mounted within a cylinder and wherein a first one of the pistons of said second hydraulic actuator means pair of hydraulic actuators and said first and second pistons of said third hydraulic actuator means pair of hydraulic actuators form a closed system, the position of the pistons of said third hydraulic actuator means pair of hydraulic actuators being controlled by said second one of the pistons of said second pair of hydraulic actuators.

5. The system of claim 2 wherein said third arm is moveable in the direction of a pivot axis of said stand.

6. The system of claim 2 wherein said second arm is shiftable between a first position and a second position relative to said third arm.

7. The system of claim 2 wherein said first arm, second arm and third arm are shiftable between a first position wherein said first arm is located on a first side of said second arm and said third arm is located on a second side of said second arm opposite said first side and a second position wherein said first arm, said second arm and said third arm are arranged in a line.

8. The system of claim 2 including a movable vehicle, said supporting being mounted on said vehicle.

9. The system of claim 8 wherein said vehicle includes bogie wheels.

10. The system of claim 8 wherein said vehicle includes a movable cab portion.

11. The system of claim 8 wherein said vehicle includes a cab portion and a second portion and an engine mounted on said second portion.

12. The system of claim 2 wherein said first rigid arm includes a free end and said free end has an arc-shaped speed curve.

13. The system of claim 2 wherein said first rigid arm includes a free end and said free end has greatest tractive force at first and second end positions and wherein an arc shaped curve defines the tractive force between said first and second end positions.

14. The system of claim 2 wherein said connection between said interconnected arm segments comprises a conical recess on one of said plurality of arm segments and a conical journal on another of said plurality of arm segments.

15. The system of claim 2 wherein said first end of said base portion of said third arm segment includes first and second opposed shafts each having a bore, said first end of said third arm includes a stud having a first and second ends adapted to fit into said bore of said first and second opposed shafts and a central bore, and a shaft journal insertable through said opposed shafts and said central bore to connect said third arm to said third arm segment.

16. The system of claim 15 wherein said shaft journal includes first and second ends and each of said first and second ends of said shaft journal includes a tensioning ring.

17. The system of claim 2 wherein said pivotable support includes a depending shaft supporting a toothed wheel and a drive for rotating said shaft to pivot said support, said drive comprising a housing, first and second movable pistons having longitudinal axes mounted in said housing;

first and second gear wheels rotatably mounted on each of said first and second movable pistons; and, at least one long, flexible member having first and second ends secured within said housing on opposite sides of and in engagement with the toothed wheel and said first and second gear wheels.

18. The system of claim 17 wherein said first and second gear wheels include central support shafts having end members and wherein said end members engage openings in said housing.

19. The system of claim 45 wherein said end members comprise a washer having an outwardly directed protrusion engaging in a groove in the wall of the housing, said groove running parallel to the axes of said first and second pistons.

20. The system of claim 46 wherein the axes of the pistons are substantially parallel and wherein said flexible member encircles at least 180 degrees of said toothed wheel.

21. The system of claim 17 wherein said longitudinal axes are substantially perpendicular.

22. The system of claim 17 wherein said flexible member comprises a chain.

23. The system of claim 17 wherein said flexible member comprises a cogged belt.

24. The system of claim 17 wherein said drive comprises a cylinder connected to said shaft, at least one arc shaped link connected to a surface of said cylinder and a piston connected to each of said at least one link, whereby moving said piston linearly causes the rotation of said cylinder.

25. The system of claim 24 wherein said at least one link comprises two links.

* * * * *